US008834140B2

(12) United States Patent
Arnold et al.

(10) Patent No.: US 8,834,140 B2
(45) Date of Patent: Sep. 16, 2014

(54) LEAKAGE LOSS FLOW CONTROL AND ASSOCIATED MEDIA FLOW DELIVERY ASSEMBLY

(75) Inventors: Felix Arnold, Neckarsteinach (DE); Dieter Amesoeder, Bletighelm-Bissingen (DE); Marian Kacmar, Stuttgart (DE); Oliver Laforsch, Stuttgart (DE)

(73) Assignee: Cor Pumps + Compressors AG, Stuttgart (DE)

( * ) Notice: Subject to any disclaimer, the term of this patent is extended or adjusted under 35 U.S.C. 154(b) by 1145 days.

(21) Appl. No.: 12/661,959

(22) Filed: Mar. 26, 2010

(65) Prior Publication Data

US 2010/0233000 A1 Sep. 16, 2010

Related U.S. Application Data

(63) Continuation-in-part of application No. 11/597,436, filed as application No. PCT/DE2005/000934 on May 19, 2005, now abandoned.

(30) Foreign Application Priority Data

May 25, 2004 (DE) ..... 10 2004 026 048

(51) Int. Cl.

| | |
|---|---|
| ***F01C 3/00*** | (2006.01) |
| ***F01C 1/24*** | (2006.01) |
| ***F01C 3/08*** | (2006.01) |
| ***F01C 21/00*** | (2006.01) |

(52) U.S. Cl.

CPC ..... *F01C 3/085* (2013.01); *F01C 21/005* (2013.01)

USPC ..... 418/71; 418/109; 418/68; 418/75; 418/195

(58) Field of Classification Search

USPC ..... 418/195, 68, 71, 75

See application file for complete search history.

(56) References Cited

U.S. PATENT DOCUMENTS

| | | | | |
|---|---|---|---|---|
| 32,372 | A | 5/1861 | Jones et al. | |
| 1,678,050 | A | 7/1928 | Kearney | |
| 2,049,775 | A | 8/1936 | Holmes | |
| 2,501,998 | A | 3/1950 | Dutrey | |
| 4,548,559 | A | 10/1985 | Willimczik | |
| 5,085,187 | A | 2/1992 | Black | |
| 5,513,969 | A | 5/1996 | Arnold | |
| 6,168,404 | B1 * | 1/2001 | Gatecliff | 418/55.5 |
| 7,275,920 | B2 | 10/2007 | Arnold | |
| 7,299,740 | B2 | 11/2007 | Adams | |
| 7,318,712 | B2 | 1/2008 | Arnold | |
| 7,390,181 | B2 | 6/2008 | Arnold | |
| 2003/0113217 | A1 | 6/2003 | Bachmann | |

(Continued)

FOREIGN PATENT DOCUMENTS

| | | |
|---|---|---|
| CH | 476 212 | 7/1969 |
| DE | 28 30 349 | 1/1980 |

(Continued)

*Primary Examiner* — Mary A Davis
*Assistant Examiner* — Anthony Ayala Delgado
(74) *Attorney, Agent, or Firm* — Jordan and Hamburg LLP

(57) ABSTRACT

A media delivery assembly in which a defined compensating pressure is established at the backs of included axially adjustable rotors and a control valve is provided for establishing the compensating pressure at a predetermined value between a pressure on the pressure side and a pressure on the suction side.

14 Claims, 2 Drawing Sheets

(56) References Cited

U.S. PATENT DOCUMENTS

| | | | | |
|---|---|---|---|---|
| 2005/0175493 | A1* | 8/2005 | Arnold | 418/68 |
| 2007/0253851 | A1 | 11/2007 | Arnold | |
| 2008/0219876 | A1 | 9/2008 | Arnold | |

FOREIGN PATENT DOCUMENTS

| | | | |
|---|---|---|---|
| DE | 29 46 304 | | 5/1981 |
| DE | 42 41 320 | | 6/1993 |
| DE | 100 25 723 | | 11/2001 |
| DE | 103 35 939 | | 4/2004 |
| DE | 10335939 | A1 * | 4/2004 |
| DE | 10 2004 044297 | | 5/2005 |
| EP | 1 005 604 | | 6/2000 |
| GB | 1 188 977 | | 4/1970 |
| GB | 2 023 740 | | 1/1980 |
| JP | 7-501597 | | 2/1995 |
| WO | WO-2004/015245 | | 2/2004 |
| WO | WO-2005/116403 | | 12/2005 |

* cited by examiner

LEAKAGE LOSS FLOW CONTROL AND ASSOCIATED MEDIA FLOW DELIVERY ASSEMBLY

CROSS-REFERENCE TO RELATED APPLICATIONS

This application is a Continuation-in-Part application of prior U.S. Nonprovisional patent application Ser. No. 11/597,436, filed Jan. 25, 2007, which was the National Stage of International Application No. PCT/DE2005/000934, filed May 19, 2005, and which claimed the benefit of German Patent Application No. 10 2004 026 048.6, filed May 25, 2004; whereby each of the aforementioned prior applications is incorporated by reference herein.

BACKGROUND OF THE INVENTION

The invention starts out from a rotating piston machine, which can operate as a pump, a compressor or an engine. In the case of a known rotating piston machine of the generic type (German patent 42 41 320, European patent 1,005,604), a high leakproofness between the working chambers is aimed for also by means of the configuration of the teeth, in order to keep the leakage as small as possible from one working chamber to the adjacent working chamber over the flanks with line contact between driving a driving rotor and a driven rotor and vice versa. In this connection, the crests of the tooth of one rotor proceed linearly at the flanks of the other rotor, the course of the working surface of which is cycloidal.

The output, required from such a rotating piston machine, varies depending on the use, to which it is put. For this purpose, different control and regulating methods are known. The simplest method is to combine the pressure and suction sides of the machine. However, with regard to the high energy taken up by the machine, this makes hardly any difference. In many cases, especially when used as a lubricating pump in the motor vehicle sector, but also when used as a presupply pump for a diesel fuel injection system, every effort is made to keep the energy, taken up by the machine, as low as possible and to adapt it to the actual power output (see German Offenlegungsschrift 100 25 723).

In comparison to the above, the inventive rotating piston machine with the characterizing distinguishing features described herein has the advantage that the energy, taken up by the rotating piston machine, corresponds directly to the power output of the same. A leakage loss of such a machine, which can never be avoided completely, has become a quantity control or loss quantity control, which is brought about by a selective change in the gap width. A further advantage consists therein that foaming, which may arise, for example, when controlling the return channel, is largely prevented, for example, when fuel or oil is pumped.

It is known that, by connecting the suction side with the pressure side directly (DE 100 25 723), a corresponding decrease in energy uptake can be achieved in fuel pumps. However, such systems do not involve working chambers located on the front faces of the rotors and, instead, are concerned with gear pumps with radially disposed cogs or annular gears with a completely different mode of operation from the very start (displacement in the axial direction), so that such variously known solutions cannot be used for the invention. Accordingly, for an oil pump, which also works with a gear wheel and an annular gear, it is known (U.S. Pat. No. 5,085,187) that the pump working chambers may be closed off laterally by a lid, which is shifted when the pumping pressure is sufficiently high, so that a connection is established between the suction space and the pressure space of the oil pump.

For adapting the energy uptake to the actual power output of rotating piston machines with gearing at the front (U.S. Pat. No. 2,049,775), it is known that the driven rotor may be swiveled within a spherical bearing, in order to change the axial angle between the axes of rotation by these means, which may lead correspondingly to a change in the amount pumped up to a zero amount pumped. It is a disadvantage of such a construction that the costs of construction are considerably higher and the output capability is more limited. Moreover, above all, the sealing of the working chambers from the adjusting device is a disadvantage.

Additionally, a media delivery assembly is known from DE 103 35 939 A1, comprising a driving rotor and a driven rotor driven by the driving rotor, which are rotatably mounted in a rotor housing and interact by meshing with each other by way of spur gears, wherein at least one of the rotors can be axially adjusted and, to the rear thereof, facing away from the other rotor, a compensating pressure can be applied by way of a compensating channel. The compensating pressure both acts counter to the axial pressure forces developing in the working chambers that are formed between the rotors, and compensates for forces that would push the two rotors apart. This ensures that the distance between the rotors does not change. The compensating pressure often corresponds to the pressure of the pressure side of the delivery assembly, and thus necessitates considerably higher forces on the rotors. This produces increased friction in the bearings and between the rotors. Supply can also be made to the back of the rotor by way of gap flows. This is disadvantageous in that an undefined compensating pressure develops, which is dependent on the leakage flows flowing into the space, or out of the space, behind the rotor. In this embodiment as well, the amount of compensating pressure is not ideal for low-friction operation.

SUMMARY OF THE INVENTION

According to an advantageous development of the invention, at least the axially displaceable rotor is guided axially and radially in a corresponding, cylindrical control space of the machine housing. The displaceable rotor, moreover, is disposed equiaxially with the cylindrical control space.

According to an embodiment of the invention, which is advantageous in this respect, the adjusting force is arbitrarily controllable and works with hydraulic, gaseous and/or electrical means. It is of decisive importance that forces on the back of the rotor counteract the pressures in the working chambers, in order to control the desired axial displacement of the rotor and, with that, the leakage between the working chambers.

According to an additional development of the invention, the chamber, which is bounded by the back of the rotor, is closed off pressure tight in order to produce an adjusting force by means of a liquid or gaseous medium.

According to a development of the invention, which is advantageous in this regard, the medium pumped generates the adjusting force. By these means, the delivery pressure of the machine can be used directly to regulate the adjusting force. Correspondingly, according to a development of the invention, there is a connection between the working chambers and the control space for the medium delivered.

According to an additional advantageous development of the invention, one of the rotors (shaft rotor) is constructed spherically on the side averted from the working chamber and supported in a correspondingly spherical recess in the housing. The radial support of the rotor can cut into this sphere in order to fix the axial axis of rotation of the rotor.

According to an additional, advantageous development of the invention, there is, at the rotors in the middle region of the front side centrally a spherical surface at a rotor. This spherical surface is supported on a corresponding spherical recess at the other rotor and forms the boundary of the working chambers radially to the inside. By the axial displacement of the one rotor, an additional connection for the leakage between the working chambers is produced over this region.

Additionally, in contrast, the delivery assembly according to the invention having the characterizing features described herein is advantageous in that a defined compensating pressure is established at the back of the axially adjustable rotor, by way of providing a control valve, which sets the compensating pressure to a predetermined value between a pressure on the pressure side and a pressure on the suction side. The compensating pressure is established as a function of the particular operating point of the delivery assembly, and specifically is established at a value which allows the delivery assembly to be operated with the lowest friction possible. A defined force is applied to the rotor by way of the pressure established in this way on the rear surface of the rotor. The pressure on the suction side and the pressure on the pressure side apply forces to the rotors which work to drive the rotors apart. Since the pressurized areas remain the same, the ideal compensating force on the rotors is proportional to the pressure difference between the pressure side and the suction side. For this reason, a proportional valve is well suited to compensate for the forces, and thereby reduce the friction between the rotors, between the rotors and the housing, and in the bearings. This results in lower wear and higher efficiency. The compensating pressure can be employed in a compensating manner either on one rotor, or on both rotors. Furthermore, different compensating pressures can be produced for the two rotors by using two proportional valves.

According to an advantageous embodiment, the control valve comprises a control plunger and three control chambers that are separated from each other by the control plunger, wherein the pressure on the pressure side is applied to the first control chamber of the control valve and the pressure on the suction side is applied to the second control chamber, wherein the third control chamber can be fluidically connected to the first chamber or the second chamber by way of a control channel provided on the control plunger. In this way, a compensating pressure is established, which has a value between a pressure on the pressure side and a pressure on the suction side.

It is particularly advantageous to design the inlet cross-section of the control channel so that it can be varied as a function of the position of the control plunger, as in this way a predetermined pressure loss is achieved.

Furthermore, the control plunger advantageously extends through a through-channel between the first and second chambers, wherein the variable inlet cross-section of the control valve is achieved by partial coverage of the inlet cross-section by the wall of the through-channel. In this way, a predetermined pressure loss is produced at the control valve.

It is very advantageous to use a proportional valve as the control valve, wherein the quotient of the difference between the compensating pressure and suction pressure and the difference between the pressure on the pressure side and suction pressure is constant.

It is also advantageous for pressure from two mutually counteracting valve springs to be applied to the control plunger, as in this way the control plunger is restored into a predetermined starting position when shutting off the delivery assembly.

It is also advantageous, as provided herein, to attach the control valve to the rotor housing of the delivery assembly, or to integrate such valve in the rotor housing.

Furthermore, the pressure of the third control chamber is advantageously fed, via a flow connection, to the back of the axially adjustable rotor, as in this way the compensating pressure established at the control valve can reach the back of the rotor.

Further advantages and advantageous developments of the invention may be inferred from the following description, the drawing and the claims.

DESCRIPTION OF THE PREFERRED EMBODIMENTS

Figure 1:
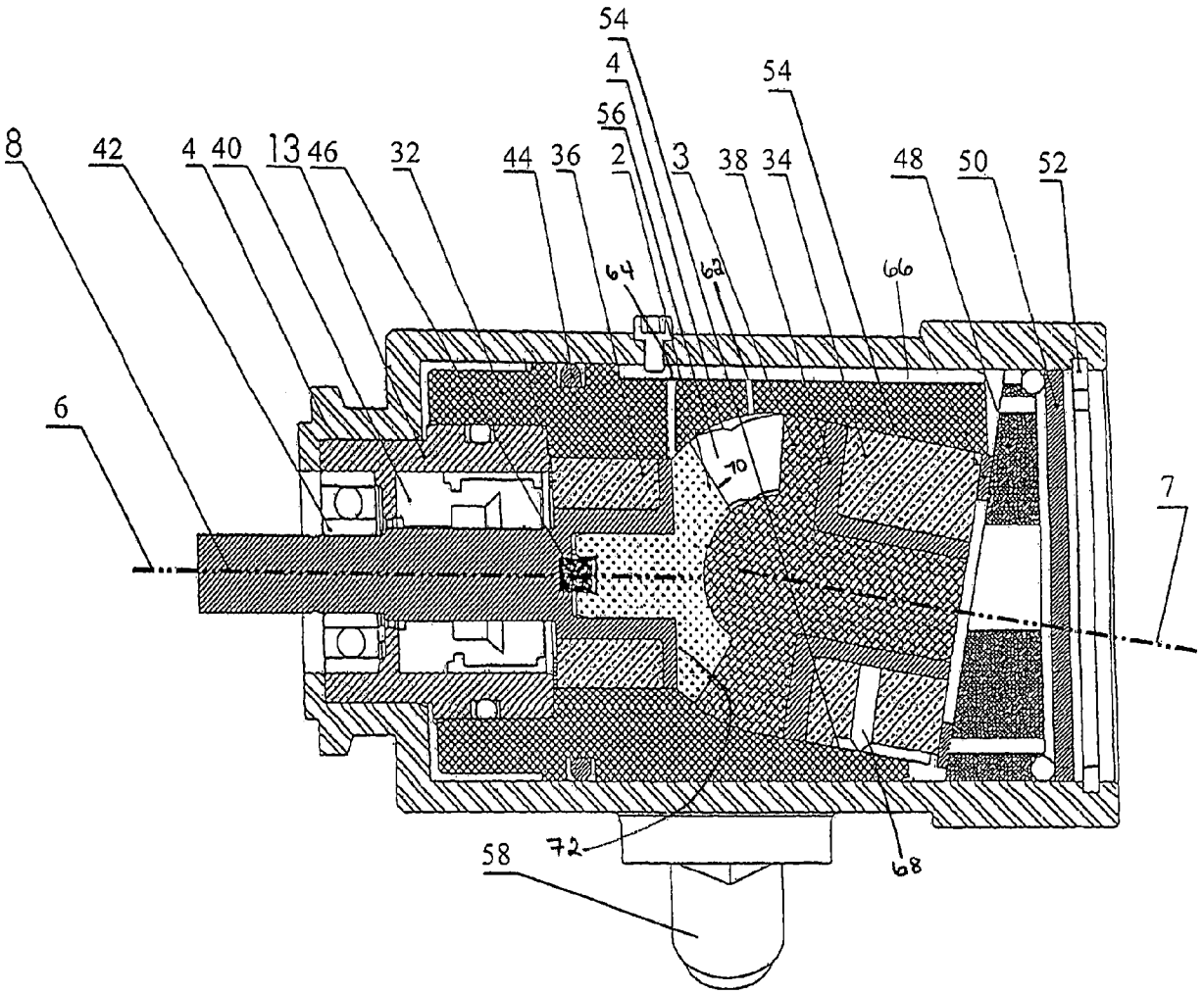
FIG. 1 shows an embodiment of the leakage loss flow control and associated flow delivery assembly in longitudinal section.
Figure 2:
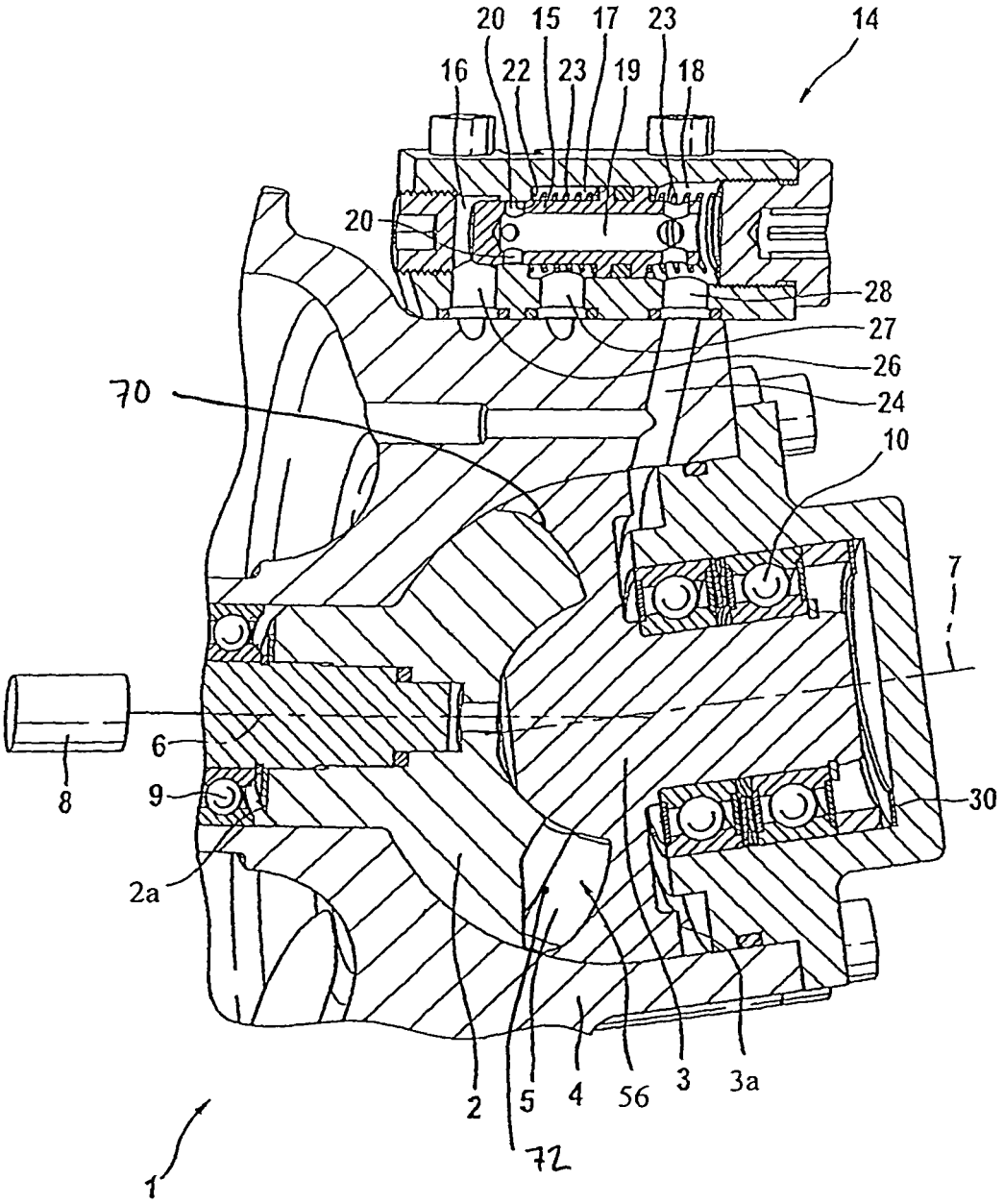
FIG. 2 shows the leakage loss flow control and associated flow delivery assembly of FIG. 1 in an embodiment which includes a control valve thereof.

When referring to FIGS. 1-2, a media delivery assembly 1 is shown in which an inlay 32 is disposed in a housing 4 so that it cannot twist. A (driven) counter rotor 3, which interacts with a (driving) shaft rotor 2, which is driven from outside the pump, is disposed rotatably and radially guided and axially displaceably in the housing 4. On mutually facing front sides, the shaft rotor 2 and the counter rotor 3 have meshing gearings 5, through which working chambers 56 are separated from one another in a known manner and over which the counter rotor 3 is driven by the shaft rotor 2. One of the two front gearings 5 has a cycloidal cross section, in order to form by these means a linear connection between the gear crests of the other part and this cycloidal surface.

The working chambers 56, the details of which are not shown Here, have a capacity which changes continuously during the operation because of the changing angle between the respective axes 6 and 7 of rotation of the respective rotors 2 and 3. The working chambers 56 are connected corresponding to their pumping task via a suction connection 58 and a pressure connection (analagous to suction connection, and therefore not depicted) with a suction channel (suction kidney) and a pressure channel (pressure kidney), respectively. For example, a working chamber at a suction side 70 is connected via the suction connection 58 to a suction side inlet 26 and a working chamber at a pressure side 72 is connected to a pressure side inlet 27 of a control valve 14 (See FIG. 2).

The counter rotor 3 is disposed rotatably in a plain bearing bush 34. Between the plain bearing bush 34 and the counter rotor 3, a plain bearing shaft 38 is disposed, which is supported radially and axially in the plain bearing bush 34 and, together with the counter rotor 3, can be shifted axially within the plain bearing bush 34.

The shaft rotor 2 is also supported radially and axially in a plain bearing bush 36. The hat-shaped end of a drive shaft 8 protrudes between the shaft rotor 2 and the plain bearing bush 36 and the shaft rotor 2 dips with a corresponding cylindrical section into this hat-shaped formation. Between the bottom of the hat-shaped section of the drive shaft 8 and the dipping section of the shaft rotor 2, a spring 46 is disposed, which, on the one hand, carries along the shaft rotor 2 as the shaft 8 rotates and, on the other, puts the shaft rotor 2 under a load in the direction of the counter rotor 3.

On the side averted from the shaft 8, the housing 4 is closed off by lids 48 and 50. The lid 48 on the inside is supported on, the one hand, at the plain bearing bush 34 and, on the other, at the lid 50 on the outside, which functions as the actual closing part of the housing 4 of the pump and is secured in its axial position towards the outside by a retaining ring 52.

Pursuant to the invention, the counter rotor 3 is displaceable axially in the direction of its axis of rotation 7. Pursuant to the invention, this displacement can be accomplished with appropriate means provided in the form of the pressure which develops in the working chambers so as to form a corresponding adjusting force which affects the counter rotor 3. This adjusting force acts counter to a restoring force, which is formed in the example shown, by liquid, and acts on the section of the counter rotor 3, which dips into the plain bearing bush 34 and is averted from the working chambers 56. To control this counter force, there is a connection (not shown) between these chambers, the forces having to be matched to one another, especially because of the surfaces acted upon. According to an advantageous development of the invention, at least the axially displaceable rotor (in the depicted example, counter rotor 3) is guided axially and radially in a corresponding, cylindrical control space 54 of the machine housing.

An insert 13 is disposed in the inlay 32 in the area of the shaft 8 so as to form a seal. It holds the plain bearing bush 36 axially and, furthermore, accommodates a plain bearing seal 40, in which the shaft 8 is disposed, so that it can rotate. Moreover, the shaft 8 is supported by a ball bearing 42 in this inlay insert 13. O-rings 44 provide the necessary seal between this inlay insert 13 and the inlay 32, as well as between the inlay 32 and the housing 4.

With specific reference to FIG. 2, the delivery assembly 1 is used to deliver fluid or gaseous media, such as fluids or gases. The delivery assembly 1 comprises the driving rotor 2 and the driven rotor 3 driven by the driving rotor 2, which are both rotatably mounted in the rotor housing 4 and interact by meshing with each other by way of spur gears 5. Each of the spur gears 5 is a cycloid or trochoid gear, for example, but can of course also be a different type of gear. According to the exemplary embodiment, in some sections the two rotors 2 and 3 have a spherical shape at the outer periphery thereof. The driving rotor 2 is driven by the motor 8, such as an electric motor. For each of the rotors 2 and 3, a rotor bearing 9 and 10, respectively, is provided. Each of the rotors 2 and 3 are relatively configured so that their rotor axes 6 and 7, respectively, are oriented obliquely relative to each other, i.e., they are not aligned. At least one of the two rotors 2 and 3, and specifically the counter rotor 3, as stated above, is axially adjustable. Such adjustment occurs as the axially adjustable counter rotor 3 is urged in the direction of the other rotor 2 by way of a spring element 30. The spring element 30 is a compression spring, such as a disk spring or helical spring. This ensures that the rotors 2 and 3 bear on one another at all times.

The two rotors 2, 3 are designed to be axially adjustable at the respective rotor bearings 9, 10 thereof, for example. Working chambers 56 are formed between the rotors 2 and 3, the medium being delivered through these chambers 56 by displacement. Pressure builds in the working chambers 56 where the volume is being reduced. This pressure also acts in the axial direction on the rotor bearings 9 and 10 of the rotors 2 and 3, respectively. In order to prevent the rotors 2 and 3 from lifting off, a compensating pressure is applied to the respective backs 2*a* and 3*a* of the rotors 2 and 3 facing away from the other of the rotors 2 and 3. In this way, the pressure forces acting on the rotors 2 and 3 are at least partially compensated. This is applied to both rotors 2 and 3 according to the embodiment, but this can, of course, also be implemented on only one of the rotors 2 and 3. The working chamber 56 communicate with the control space 54 to apply the compensating pressure to the respective backs 2*a* and 3*a* of the rotors 2, 3. In FIG. 1 such communication is through the flow paths 62, 64 in the inlay 32 and through a spacing between the inlay 32 and the housing 4 which is in fluid communication with the back of the rotor 3 which is open to a space 68 of the control space 54.

According to the invention, a control valve 14 is provided, which alternatively establishes the compensating pressure acting on the rotor backs 2*a* and 3*a* at a predetermined value between a pressure on the pressure side and a pressure on the suction side. A working chamber 56 at a suction side 70 is connected to a suction side inlet 26 and a working chamber 56 at a pressure side 72 is connected to a pressure side inlet 27. In this way, the compensating pressure is established at a predetermined value as a function of the particular operating point of the delivery assembly, and specifically is established at a value which allows the delivery assembly to be operated with the lowest friction possible.

The control valve 14 comprises a control plunger 15 and three control chambers 16, 17, 18 that are separated from each other by the control plunger 15, wherein the pressure on the pressure side is applied to the first control chamber 16 of the control valve 14 and the pressure on the suction side is applied to the second control chamber 17, wherein the third control chamber 18 can be fluidically connected to the first control chamber 16 or to the second control chamber 17 by way of a control channel 19 provided on the control plunger 15. The control channel 19 runs in the direction of the longitudinal extension of the control plunger 15.

An inlet cross-section 20 into the control channel 19 can be varied as a function of the position of the control plunger 15. The inlet cross-section 20 is formed by at least one inlet opening into the control channel 19. A plurality of inlet openings are provided at the periphery of the control plunger 15, for example. The control plunger 15 extends through a through-channel 22 between the first control chamber 16 and the second control chamber 17, wherein the variable inlet cross-section of the control valve 14 is achieved by partial coverage of the inlet cross-section by the wall of the through-channel 22. At the end facing away from the inlet cross-section 20, the control channel 19 opens into the third control chamber 18. The pressure of the third control chamber 18 is fed via a flow duct 24 to the backs 2*a*, 3*a* of the rotors 2 and 3, respectively.

The control valve 14 can be attached to the rotor housing 4 of the delivery assembly or integrated in the rotor housing 4. The control valve 14 has two inlets 26, 27 for connecting to the suction and/or pressure sides of the delivery assembly (e.g., to a suction side 70 working chamber via suction connection 56 and to a pressure side 72 connection working chamber via a pressure connection-see FIGS. 1 and 2) and an outlet 28 for connecting to the flow duct 24 leading to the respective backs 2*a*, 3*a* of the rotors 2 and 3.

The control valve 14 is designed as a proportional valve, for example. Pressure from two mutually counteracting valve springs 23, for example, is applied to the control plunger 15 in order to ensure that it is returned to a starting position.

All the distinguishing features, shown in the specification, in the claims that follow and in the drawing, may be essential to the invention individually as well as in any combination with one another.

The invention claimed is:

1. A rotary piston machine, comprising:

a shaft rotor;

a counter rotor, the shaft rotor and the counter rotor having respective axes of rotation which are arranged at a particular axial angle to one another;

mutually meshing gears on mutually facing front sides of the shaft rotor and the counter rotor facing one another and limiting working chambers there between;

a machine housing in which the shaft rotor and the counter rotor are supported radially and axially, a suction connection and a pressure connection in fluid communication with the working chambers at respective positions of a rotational cycle of the shaft rotor and the counter rotor, said respective positions being selected to provide suction and pressure at the suction connection and the pressure connection, respectively, when the shaft rotor and the counter rotor are rotated;

at least one rotor of the shaft and counter rotor in the machine housing being mounted in an axially displaceable manner in a direction of the axis of rotation of the counter rotor, said at least one of the shaft and counter rotor which is axially displaceable being rotationally arranged in a plain bearing bush provided in the machine housing;

structure defining a control space provided in said housing said control space being formed on a section of said at least one of the shaft and counter rotor that is averted from the working chambers and that extends into the plain bearing bush;

a fluid communication path between the control space and the working chambers configured to transfer fluid from the working chambers to the control wherein said at least one rotor has a working pressure force acting at said front sides by working pressure of fluid in the working chambers and has an adjusting force acting by the transfer fluid on an extended section that extends into the plain bearing bush; and wherein the fluid communication path is configured for the adjusting force to counteract the working pressure force and adjust relative axial position between said shaft rotor and counter rotor; and a control valve having a control plunger spanning across a first, second and third control chambers, the first control chamber being coupled to a pressure connection, the second control chamber being coupled to the suction connection, the third control chamber being coupled to a backside of at said at one of the shaft and counter rotor; wherein said fluid communication path comprises a control channel within the control valve, wherein the control channel is within the control plunger extending along a length of the control plunger to an opening to the third control chamber towards one end of the control channel, the control plunger having a control inlet towards another end of the control channel; wherein the control inlet provides fluid communication from at most one of either the first control chamber or the second control chamber into the control channel at a given time according to an axial position of the plunger; and wherein the control inlet is configured at the plunger to have an area exposed for fluid flow that is variable as a function of the position of the control plunger, so that during a first axial range of motion of the control plunger for which the control inlet is exposed to the first control chamber varies to control amount of flow between the first control chamber and the control channel, and so that during a second, different axial range of motion of the control plunger for which the control inlet is exposed to the second control chamber the area exposed to the second control chamber varies to control amount of flow between the second control chamber and the control channel.

2. A rotary piston machine according to claim 1, wherein said at least one of the shaft and counter rotor which is axially displaceable is guided axially and radially in the correspondingly cylindrical control space of the machine housing.

3. A rotary piston machine according to claim 1, wherein the fluid, when pumped, generates the adjusting force.

4. A rotary piston machine according to claim 1, wherein one of the shaft and counter rotor is constructed spherically on a side thereof averted from the working chambers, and is supported in a correspondingly spherical recess in the housing.

5. A rotary piston machine according to claim 1, wherein one of the shaft and counter rotor includes a spherical surface in a radially central region of the axial front side thereof, the spherical surface being supported at a corresponding spherical radially central recess at a remaining one of the shaft and counter rotor, forming a radially inner boundary of the working chambers.

6. A rotary piston machine according to claim 1, wherein said at least at least one of the shaft and counter has a back face, and wherein said fluid communication path is configured to expose said back face to the transfer fluid creating said adjusting force that acts to counteract the working pressure force that acts at said front sides.

7. A media delivery assembly comprising:

a driving rotor;

a driven rotor driven by the driving rotor; and a control valve; and wherein each one of the driving and driven rotor being is rotatably mounted in a rotor housing and interacts by meshing with each other by way of spur gears;

wherein at least one of the each one of the driving and driven rotor being is axially adjustable and subjected to a compensating pressure at a back side thereof, facing away from the other one of the driving and driven rotors: wherein the control valve controls the compensating pressure so as to set the compensation pressure at a predetermined value between a pressure on a pressure side and a pressure on a suction side; and wherein the control valve comprises a control plunger spanning across first, second and third control chambers, the first control chamber being coupled to the pressure side, the second control chamber being coupled to the suction side, the third control chamber being coupled to the back side of at least one of the driving rotor and driven rotor; wherein the control plunger has a control channel extending along a length of the control plunger to an opening to the third control chamber toward one end of the control channel, the control plunger having a control inlet toward another end of the control channel;

wherein the control inlet provides fluid communication from at most one of either the first control chamber or the second control chamber into the control channel at a given time according to an axial position of the plunger; and wherein the control inlet is configured at the plunger to have an area exposed for fluid flow that is variable as a function of the position of the control plunger, so that during a first axial range of motion of the control plunger for which the control inlet is exposed to the first control chamber the area exposed to the first control chamber varies to control amount of flow between the first control chamber and the control channel, and so that during a second, different axial range of motion of the control plunger for which the control inlet is exposed to the second control chamber the area exposed to the second control chamber varies to control amount of flow between the second control chamber and the control channel.

8. The media delivery assembly according to claim 7, wherein the control valve is a proportional valve.

9. The media delivery assembly according to claim 7, wherein pressure from two mutually counteracting valve springs is applied to the control plunger.

10. The media delivery assembly according to claim 7, wherein the control valve is attached to the rotor housing.

11. The media delivery assembly according to claim 7, wherein the control valve is integrated in the rotor housing.

12. The media delivery assembly according to claim 7, wherein the third control chamber is coupled, respectively, to the back side of both the driving rotor and the driven rotor.

13. The media delivery assembly according to claim 7, wherein the driving rotor and the driven rotor have cycloid gears.

14. The media delivery assembly according to claim 7, wherein the driving rotor and the driven rotor have trochoid gears.

* * * * *